United States Patent [19]

Pogonowski

[11] 4,064,703

[45] Dec. 27, 1977

[54] METHODS AND GUN FOR ANCHORING PILES AND FOR TEMPORARILY INTERCONNECTING TWO CYLINDERS UNDERWATER

[75] Inventor: Ivo C. Pogonowski, Blacksburg, Va.

[73] Assignee: Texaco Inc., New York, N.Y.

[21] Appl. No.: 644,367

[22] Filed: Dec. 24, 1975

[51] Int. Cl.[2] ..... E02D 5/56

[52] U.S. Cl. ..... 61/53.68; 29/522 R; 29/526 R; 227/9

[58] Field of Search ..... 61/53.68, 53.6, 53, 61/46.5, 46; 52/726, 298, 288; 227/9; 29/522, 526

[56] References Cited

U.S. PATENT DOCUMENTS

| | | | |
|---|---|---|---|
| 3,921,427 | 11/1975 | Malone et al. | 61/53.68 |

FOREIGN PATENT DOCUMENTS

| | | | |
|---|---|---|---|
| 599,786 | 7/1934 | Germany | 61/53.68 |
| 1,034,128 | 6/1966 | United Kingdom | 61/53.68 |

*Primary Examiner*—Jacob Shapiro

*Attorney, Agent, or Firm*—Thomas H. Whaley; Carl G. Ries; Theron H. Nichols

[57] ABSTRACT

Methods and mechanisms for anchoring piles or offshore tower legs to the soil therearound and for joining two telescopic cylinders underwater in a temporary and inexpensive manner are disclosed. A gun fires projectiles radially from internally of the pile to form the plurality of outwardly extending anchoring bumps in the pile. After forming the bumps in the buried pile and simultaneously packing the soil around them, each projectile penetrates its bump and packed soil to provide a pile with increased load-carrying-capacity and with increased resistance-to-pull-out. Likewise, projectiles are fired in a horizontal plane radially outwardly and from within and normal to two telescopic cylinders underwater, for example, with two bumps being formed by each projectile, which bumps overlie each other tightly prior to their being penetrated by the projectile which holds the two bumps together. A number of radiating guns form a like number of pairs of bumps in a circle around the periphery of the telescopic cylinders to form an efficient, inexpensive, and simple temporary connection holding the two cylinders together.

7 Claims, 6 Drawing Figures

METHODS AND GUN FOR ANCHORING PILES AND FOR TEMPORARILY INTERCONNECTING TWO CYLINDERS UNDERWATER

BACKGROUND OF THE INVENTION

An age-old problem has been to increase the load-carrying capacity of a pile and to increase its resistance against pullout in sandy or other granular soil, for example. Another problem has been the temporary joining of two tubes or cylinders, as when erecting an offshore tower with telescopic leg joints underwater to be held in place until permanently joined or fixed in position. Another problem is to temporarily join two cylinders without expensive and costly prior preparation.

The disclosed invention is an improvement over my prior methods and mechanisms for connecting two telescopic tubes together underwater illustrated in my U.S. Pat. No. 3,555,831, of Jan. 19, 1971, or U.S. Pat. No. 3,834,012 of Sept. 10, 1974. Other examples of increasing pile pullout resistance as by forming corrugations or bumps are disclosed in U.S. Pat. No. 3,453,831(7–69); U.S. Pat. No. 3,375,670 (4–68); British Pat. No. 1,034,128 of 1964; and German Pat. No. 599,785 of 1934, over which the disclosed invention is a substantial improvement.

OBJECTS OF THE INVENTION

Accordingly, a primary object of this invention is to provide a method for anchoring a pile in sandy soil, particularly underwater.

Another primary object of this invention is to provide a method for interconnecting two telescopic cylinders, particularly underwater.

A further object of this invention is to provide a highly load-carrying-capacity and a highly resistant-to-pullout pile.

A still further object of this invention is to provide a mechanism for interconnecting two telescopic cylinders underwater in an efficient, quick, and economical manner.

A further object of this invention is to provide a mechanism for anchoring a pile that is easy to operate, is of simple configuration, is economical to build and assemble, and is of greater efficiency for providing increased load-carrying-capacity and of increased resistance-against-pullout in a sandy or other granular soil.

Other objects and various advantages of the disclosed pile-setting device and telescopic tube interconnecting mechanism will be apparent from the following detailed description, together with accompanying drawings, submitted for purposes of illustration only and not intended to define the scope of the invention, reference being had for that purpose to the subjoined claims.

BRIEF DESCRIPTION OF THE DRAWINGS

The drawings diagrammatically illustrate by way of example, not by way of limitation, a few forms or mechanisms for carrying out the method of the invention wherein like reference numerals have been employed to indicate similar parts in the several views in which.

DESCRIPTION OF THE INVENTION

The invention disclosed herein, the scope of which being defined in the appended claims, is not limited in its application to the details of construction and arrangement of parts shown and described for carrying out the disclosed methods, since the invention is capable of other embodiments for carrying other methods and of being practiced or carried out in various other ways. Also, it is to be understood that the phraseology or terminology employed herein is for the purpose of description and not of limitation. Further, many modifications and variations of the invention as hereinbefore set forth will occur to those skilled in the art. Therefore, all such modifications and variations which are within the spirit and scope of the invention herein are included and only such limitations should be imposed as are indicated in the appended claims.

DESCRIPTION OF THE METHODS

This invention comprises a method for anchoring a pile in the ground and a method for connecting telescopic cylinders together, particularly underwater, and a mechanism for practicing the methods.

METHOD FOR ANCHORING A PILE UNDERWATER

A method for anchoring a hollow cylindrical pile in a sandy soil strata and other granular soils as illustrated in FIGS. 1–4, comprises the steps of, 1. driving the hollow cylindrical pile into the sandy soil strata,
2. removing the soil from within the pile at least down to the sandy soil strata,
3. driving a plurality of headed spikes from within the hollow pile radially outwardly in a horizontal plane into the cylindrical pile walls,
4. forming a plurality of outwardly extending bumps in the horizontal plane in the outer periphery of the cylindrical pile walls by outward movement of the headed spikes,
5. simultaneously packing the soil around the horizontal row of bumps in the pile for forming of the bumps outwardly with the headed spikes, and
6. penetrating the bumps with the headed spikes for forming a horizontal row of anchoring extensions in the packed soil around each bump on a pile by continued driving of the plurality of headed spikes radially outwardly of the hollow pile in a horizontal plane after forming of the bumps to penetrate the pile cylindrical walls and the packed soil until only the spike heads remain in the hollow cylindrical pile for increasing the loan-carrying-capacity and the resistance-to-pullout in the sandy and other granular soils.

METHOD OF INTERCONNECTING TWO TELESCOPIC CYLINDERS UNDERWATER

Figure 5:
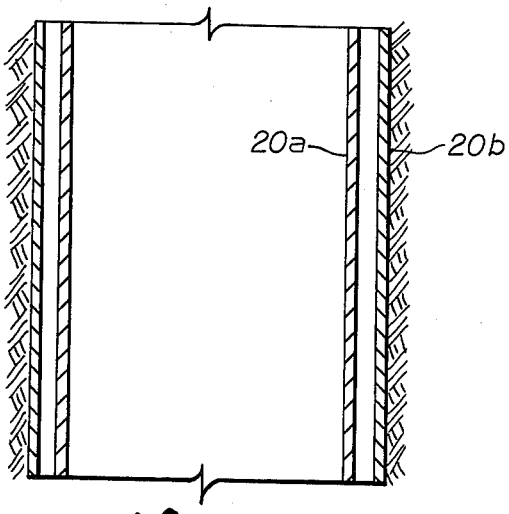
FIG. 5 is a schematic longitudinal sectional elevation of a portion of two telescopic cylinders prior to being fastened together.
Figure 6:
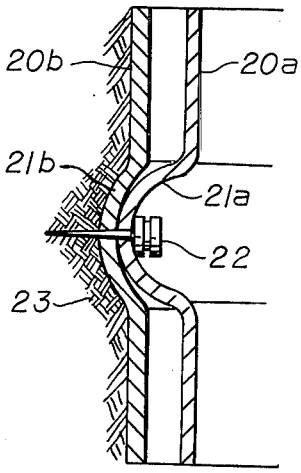
FIG. 6 is a longitudinal sectional elevation of a portion of two telescopic cylinders of FIG. 4 joined together.

A method for temporarily interconnecting two telescopic cylinders underwater as illustrated in FIGS. 5 and 6, comprises the method steps of, 1. inserting a plurality of spike guns into the inner telescopic cylinder to the desired depth radiating outwardly in a horizontal plane,
2. firing the spikes radially outwardly into the two telescopic cylinders for forming a plurality of outwardly extending pairs of bumps in the horizontal plane in a circle around the peripheral surface of the two telescopic cylinders,
3. forming the bump of each pair lying in close juxtaposition with each other,
4. penetrating each pair of bumps with a headed spike after forming of the bumps, and
5. driving the headed spikes outwardly through both bumps until only the heads remain in the inner cylinder bump for squeezing each pair of bumps together in a temporary joint underwater.

A HIGH LOAD CARRYING CAPACITY AND HIGHLY RESISTANT-TO-PULLOUT PILE

Figure 1:
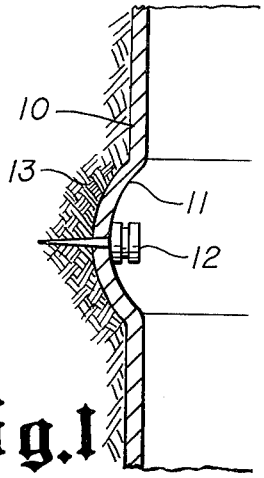
FIG. 1 is a schematic longitudinal sectional elevation of the portion of the pile in the ground having a new soil-holding feature.

FIG. 1 discloses a longitudinal sectional elevation of a portion of the pile 10 that is driven in the ground having the new soil-holding feature on it. This portion of the pile has a bump 11 formed in one side of it with a headed spike 12 driven into a middle of the bump and into the resultant packed soil 13 therearound. It may be noted that as the headed spike is driven into the pile wall from the inside, it first bulges out the side wall, making the hemispherical bump and packing the soil in that immediate area, then with added pressure and force the headed spike is driven through the center of the bump to protrude it completely outwardly into the dirt that has been packed around the bump. The packing of the dirt around the bump occurred with forming of the bump to compress the dirt that was around the vertical wall prior to the material of the bump being moved outwardly and compressing the dirt thereagainst.

Figure 2:
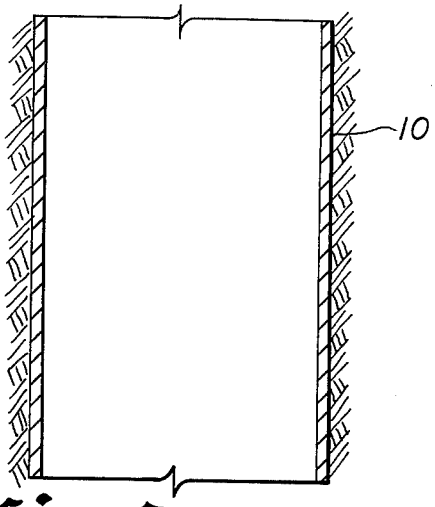
FIG. 2 is a schematic longitudinal sectional elevation of the pile of FIG. 1 prior to bulging and penetrating of the pile with headed spikes.

FIG. 2 is a schematic longitudinal sectional elevation of the pile 10 of FIG. 1 prior to bulging or penetrating of the pile with the headed spikes. Here a portion of the pile is shown driven into the dirt or ocean bottom after the dirt has been removed internally thereof, if necessary.

Figure 3:
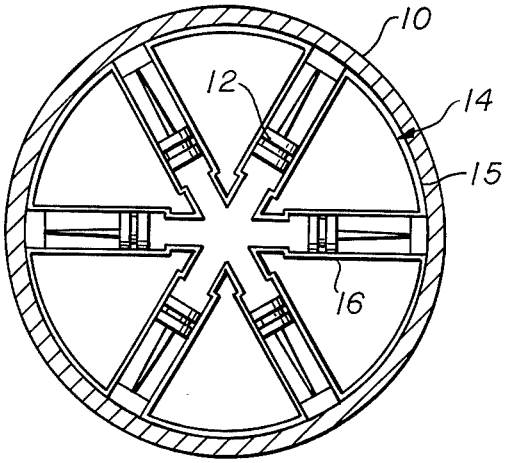
FIG. 3 is a schematic horizontal sectional view of the gun for forming the bumps in the pile walls and for driving the headed spikes into the pile wall.

FIG. 3 is a schematic view or horizontal sectional view of the gun for driving the headed spikes 12 into the side walls of the pile 10. The gun 14 is positioned or lowered down into a pile to the depth of the sand strata where the bumps are desired to be formed. Here a cylindrical housing 15 that holds a multiplicity of barrels 16, all barrels being in a horizontal plane and firing radially outwardly. Gun housing 15 includes a high pressure fluid introduced behind the headed spikes 12 as controlled from the surface similar to the hydraulic guns disclosed in my above identified U.S. Pat. No. 3,555,831, but with the spike heads acting as the piston.

If more than one horizontal row of bumps is required, a multiple row gun may be used similar to that in my U.S. Pat. No. 3,834,012. With the gun housing positioned internally of the pile and ready for firing, the headed spikes may be fired in either of two ways. First, each barrel 16 or gun may be fired in consecutive order around the outer periphery of the gun to drive its respective headed spike 12 into the pile wall 10, or the second method may comprise the simultaneous firing of all guns at one time for driving all spikes simultaneously out through the pile into the packed ground therearound each bump, depending on the particular desired hydraulic ducting and controls from the surface to the guns.

Figure 4:
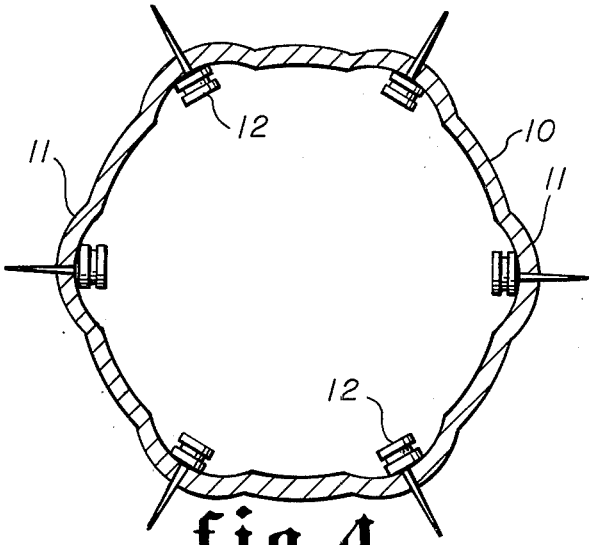
FIG. 4 is a schematic horizontal sectional view of the new pile after forming of the bulges and driving of the spikes through the walls of the cylinders by the gun of FIG. 3.

FIG. 4 is a horizontal sectional view after the gun 14 of FIG. 3 has been fired for forming the bulges and for packing the soil and for driving the spikes through the walls of the cylinder, the gun having been removed. Increased pull-out resistance results from both the bumps 11 and the headed spikes 17 protruding into the packed soil. Thus a pile having increased load-carrying-capacity and increased resistance-to-pull-out is disclosed.

A MECHANISM FOR INTERCONNECTING TWO TELESCOPIC CYLINDERS UNDERWATER

FIG. 5 is a schematic longitudinal sectional elevation or view of the portion of the two telescopic cylinders **20*a*, 20*b***, prior to being fastened together. This is a section buried underground in the area to be secured together.

FIG. 6 is a longitudinal sectional elevation of a portion of the two telescopic cylinders **20*a*, 20*b* joined together by a multiple barrel gun similar to gun 14, FIG. 3. Here, FIG. 6 the two bumps 21*a* and 21*b* are shown after having been formed by the outward actuation or movement of a headed pin 22 which pin after having pushed or formed the bumps 21*a*, 21*b*, in the two surfaces of the two cylinders 20*a*, 20*b*, has now penetrated both walls into the packed soil 23, which soil was packed by the forming of the bump 21**.

In operation of the embodiment of FIGS. 5 and 6, or for connecting the two telescoping cylinders together, at least temporarily, the guns, in this embodiment likewise, are made so that they may be fired in consecutive order around the periphery or they all may be fired simultaneously, if so desired. The guns are formed powerful enough to fire the headed spike out to engage the walls of the two bumps **21*a*, 21*b* of the two cylinders 20*a*, 20*b*. Upon first movement of the spike 22, the bulges 21*a*, 21*b*** are formed thereby for packing the soil until finally with increased force or with continued force of outward movement, the spike penetrates both walls to extend therethrough. The spikes thus form at least a temporary junction or connection connecting the two walls together and form additional means for increasing the pull-out resistance of the outer cylinder from the soil therearound.

Accordingly an efficient, inexpensive, and simple connection for holding two telescopic cylinders, as piles, together.

Obviously other methods may be utilized for anchoring piles in a sandy soil underwater and other methods may be used for interconnecting two telescopic cylindrical tubes.

Accordingly, it will be seen that the disclosed new pile mechanisms and telescopic tube mechanism, both including a particular gun, will operate in a manner which meets each of the objects set forth hereinbefore.

While only two mechanisms have been disclosed, it will be evident that various other modifications are possible in the arrangement and construction of the disclosed anchoring pile mechanisms and interconnected telescopic tube mechanism without departing from the scope of the invention and it is accordingly desired to comprehend within the purview of this invention such modifications as may be considered to fall within the scope of the appended claims.

I claim:

1. A method for anchoring a pile in a sandy soil strata and other granular soils comprising the method steps of,
   a. driving a hollow cylindrical pile deep into the sandy soil strata,
   b. forming a plurality of outwardly extending bumps in a horizontal plane around the periphery of the hollow cylindrical pile for packing the sandy soil strata around the bump by driving a plurality of headed spikes radially outwardly in the horizontal plane,
   c. penetrating each bump with a spike as the spikes are pressed outwardly further after forming the bump, and
   d. lodging each spike in the packed sandy soil strata of its respective bump with only the spike heads remaining in the hollow pile for increasing the load-carrying capacity and for increasing the resistance to pullout of the pile in the sandy soil strata and other granular soils.

2. A method for anchoring a pile in a sandy soil strata and other granular soils comprising the methods steps of,
   a. driving a hollow cylindrical pile deep into the sandy soil strata,
   b. removing the soil from within the pile at least down to the sandy soil strata,
   c. pressing outwardly a plurality of outwardly extending bumps in a horizontal plane in the hollow cylindrical pile at the sandy soil strata by firing a plurality of headed spikes from within the hollow pile radially outwardly in the horizontal plane to press the bumps outwardly in the pile cylindrical walls, whereby the soil around the bumps is packed simultaneously with outward pressing of the bumps,
   d. penetrating the bumps with the headed spikes after forming of the bumps by continued outward movement of the headed spikes until only the spike heads remain in the hollow cylindrical pile, and
   e. penetrating the soil with the spikes moving into the packed soil around the bumps for increasing the load-carrying capacity and for increasing the resistance to pullout of the pile in the sandy soil strata and other granula soils.

3. A method for anchoring a pile in a sandy soil strata and other granular soils comprising the method steps of,
   a. driving a hollow cylindrical pile into the sandy soil strata,
   b. driving a plurality of headed spikes from within the hollow pile radially outwardly in a horizontal plane into the cylindrical pile walls,
   c. forming a plurality of outwardly extending bumps in the horizontal plane in the outer periphery of the cylindrical pile walls by outward movement of the headed spikes, whereby packing of the soil around the horizontal row of bumps in the pile occurs simultaneously with forming of the bumps outwardly with the headed spikes, and
   d. penetrating the bumps with the headed spikes for forming a horizontal row of anchoring extensions in the packed soil around each bump on the pile by continued driving of the plurality of headed spikes radially outwardly of the hollow pile in a horizontal plane after forming of the bumps to penetrate the pile cylindrical wall and the packed soil until only the spike heads remain in the hollow cylindrical pile for increasing the load-carrying capacity and the resistance to pullout in the sandy and other granular soils.

4. A high load capacity pile for being anchored in sandy soil strata and other granular soils comprising,
   a. a hollow cylindrical pile for being driven down into the ground,
   b. bumps formed to extend outwardly on the peripheral surface of the cylindrical pile in a horizontal plane after the pile is driven in the ground for providing compressed soil around the bumps, and
   c. a headed spike extending radially outwardly from the center of each bump into the packed soil therearound each bump, and
   d. each spike being lodged in its respective bump for providing a pile having increased load-carrying capacity and having increased resistance-to-pullout in sandy and other granular soils.

5. A high load capacity pile comprising,
   a. a hollow cylindrical pile for being driven down into the ground,
   b. a plurality of bumps on the pile, each bump being formed in a circular row in the peripheral surface of the cylindrical pile in a horizontal plane after the pile is driven into the ground for providing compact soil around each bump, and
   c. a plurality of headed spikes protruding from the pile, each headed spike extending radially outwardly from the center of each bump into the packed soil therearound the bump for providing a pile having increased load-carrying-capacity and having an increased resistance-to-pullout in sandy and other granular soils.

6. An offshore tower supporting leg comprising,
   a. a hollow cylindrical leg for being driven down into a sandy soil strata under the ocean bottom,
   b. bulges formed extending outwardly on the peripheral surface of the hollow cylindrical leg portion at the layer of the sandy soil strata,
   c. said bulges being formed in a line on the peripheral surface of said hollow cylindrical leg in a horizontal plane,
   d. said bulges having packed soil therearound each, and
   e. headed spikes extending radially outwardly through the center of each of said bulges into the packed soil around each said bulge for providing an offshore tower supporting leg having increased load-carrying-capacity and having increased resistance-to-pullout in sandy and other granular soils.

7. An offshore tower supporting leg comprising,
   a. a hollow cylindrical leg for being driven down into a sandy soil strata below the ocean bottom,
   b. a plurality of bumps on the hollow cylindrical leg, each bump being formed in a circular row extending outwardly in the peripheral surface of the hollow cylindrical leg in a horizontal plane,
   c. each of said bumps having compact soil closely packed up against it, and
   d. a plurality of headed spikes protruding radially outwardly from the middle of each bump in the hollow cylindrical leg into the packed soil therearound each bump for providing a pile having increased load-carrying-capacity and having increased resistance-to-pullout in sandy and other granular soils.

* * * * *